US006871742B1

(12) United States Patent
Paik

(10) Patent No.: US 6,871,742 B1
(45) Date of Patent: Mar. 29, 2005

(54) FREE STANDING HOLDER FOR HOLDING FLAT ARTICLES SUCH AS PRINTED MATTER

(76) Inventor: Harry S. Paik, 3357 Conrad Dr., Bend, OR (US) 97701

( * ) Notice: Subject to any disclaimer, the term of this patent is extended or adjusted under 35 U.S.C. 154(b) by 156 days.

(21) Appl. No.: 10/235,388

(22) Filed: Sep. 3, 2002

(51) Int. Cl.[7] ..... B65D 73/00
(52) U.S. Cl. ..... 206/470; 206/471; 206/449
(58) Field of Search ..... 206/467, 470, 206/471, 449, 454, 425

(56) References Cited

U.S. PATENT DOCUMENTS

| | | | | | |
|---|---|---|---|---|---|
| 4,512,474 | A | * | 4/1985 | Harding | 206/461 |
| 4,630,731 | A | | 12/1986 | Albery | |
| D291,064 | S | * | 7/1987 | Haber et al. | D9/415 |
| 4,819,792 | A | | 4/1989 | Christian | |
| 4,930,627 | A | | 6/1990 | Borst et al. | |
| 5,011,006 | A | | 4/1991 | Anderson | |
| D321,446 | S | | 11/1991 | Liptak | |
| 5,143,215 | A | * | 9/1992 | Hartley et al. | 206/461 |
| 5,147,035 | A | | 9/1992 | Hartman | |
| 5,150,813 | A | | 9/1992 | Harris et al. | |
| D330,474 | S | | 10/1992 | Liptak | |
| 5,301,800 | A | | 4/1994 | Kenney | |
| 5,485,919 | A | * | 1/1996 | Saamberg et al. | 206/461 |
| 5,540,324 | A | * | 7/1996 | Knapp | 206/6.1 |
| 5,595,300 | A | | 1/1997 | Paik et al. | |
| 5,630,546 | A | | 5/1997 | Velch | |
| D401,765 | S | * | 12/1998 | Soutullo | D4/199 |
| D405,368 | S | * | 2/1999 | Lee | D9/415 |
| D410,495 | S | | 6/1999 | Wear | |
| D410,686 | S | | 6/1999 | Wear | |
| D418,875 | S | | 1/2000 | Paik | |
| 6,170,663 | B1 | * | 1/2001 | Glassman | 206/461 |
| D437,216 | S | * | 2/2001 | Saputo et al. | D9/415 |
| 6,227,369 | B1 | * | 5/2001 | Glassman | 206/469 |
| 6,330,945 | B1 | * | 12/2001 | Reimer | 206/470 |
| D469,348 | S | * | 1/2003 | Demus et al. | D9/415 |

* cited by examiner

*Primary Examiner*—Shian T. Luong
(74) *Attorney, Agent, or Firm*—Thomas R. Lampe

(57) ABSTRACT

A free standing holder includes a holder back, a holder bottom and a holder front defining a holder interior. The holder includes molded support legs formed by the holder back and holder bottom and the holder bottom has an inclined flat article engagement surface for promoting forward movement of the flat articles in the holder interior.

7 Claims, 2 Drawing Sheets

FREE STANDING HOLDER FOR HOLDING FLAT ARTICLES SUCH AS PRINTED MATTER

TECHNICAL FIELD

This invention relates to a free standing holder for holding and dispensing flat articles. The holder has particular application to the display and dispensing of printed matter in the form of flyers, brochures, newsletters and the like.

BACKGROUND OF THE INVENTION

Many types of holders have been devised for holding flyers or other forms of printed matter as well as other types of flat articles for access by the public. Many of these holders are devised to be hung on a post, wall or other support surface while others are of a free standing nature, being used for example on counters, tables and the like. The following patents relate to holders of various types, including free standing holders utilized to hold and dispense printed matter: U.S. Pat. No. DES.321,446, issued Nov. 12, 1991, U.S. Pat. No. 5,595,300, issued Jan. 21, 1997, U.S. Pat. No. DES.418,875, issued Jan. 11, 2000, U.S. Pat. No. DES.330,474, issued Oct. 27, 1992, U.S. Pat. No. DES.410,686, issued Jun. 8, 1999, U.S. Pat. No. DES.410,495, issued Jun. 1, 1999, U.S. Pat. No. 5,630,546, issued May 20, 1997, U.S. Pat. No. 5,301,800, issued Apr. 12, 1994, U.S. Pat. No. 4,819,792, issued Apr. 11, 1989, U.S. Pat. No. 5,150,813, issued Sep. 29, 1992, U.S. Pat. No. 5,011,006, issued Apr. 30, 1991, U.S. Pat. No. 5,147,035, issued Sep. 15, 1992, U.S. Pat. No. 4,930,627, issued Jun. 5, 1990, and U.S. Pat. No. 4,630,731, issued Dec. 23, 1986.

As will be seen below, the holder of the present invention incorporates a number of features which contribute to the strength and stability of the holder and render it particularly useful as a self supporting, free standing holder/dispenser for flat articles such as printed matter.

DISCLOSURE OF INVENTION

The holder of the present invention is of relatively simple, inexpensive construction and provides for the storage and dispensing of flat articles such as printed matter therefrom with ease. The holder is of light-weight construction and relatively strong and rigid. The holder can be configured for stacking to conserve shipping and storage space.

The invention disclosed and claimed herein is a free standing holder of unitary, molded plastic construction for positioning on a horizontal support surface and for holding flat articles to maintain the flat articles on edge in a generally vertical orientation for manual access and removal by individuals.

The holder includes a holder back and a holder bottom integral with and projecting forwardly from the holder back.

The holder further comprises a holder front spaced from the holder back. The holder back, the holder bottom and the holder front define a holder interior for accommodating the flat articles.

The holder back and the holder bottom form at least one rearwardly projecting support leg for engagement with a horizontal support surface to support the holder.

The holder bottom includes a flat article engagement surface inclined downwardly in the direction of the holder front for promoting movement of the flat articles in the holder interior toward the holder front.

Other features, advantages and objects of the present invention will become apparent with reference to the following description and accompanying drawings.

BEST MODE FOR CARRYING OUT THE INVENTION

Figure 1:
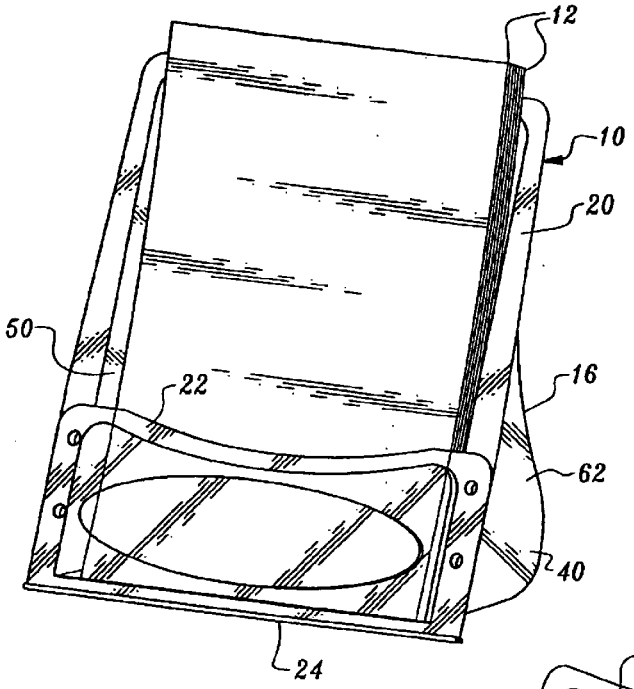
FIG. 1 is a perspective view illustrating the holder of the present invention holding printed matter and supporting the printed matter in a generally vertical orientation.
Figure 3:
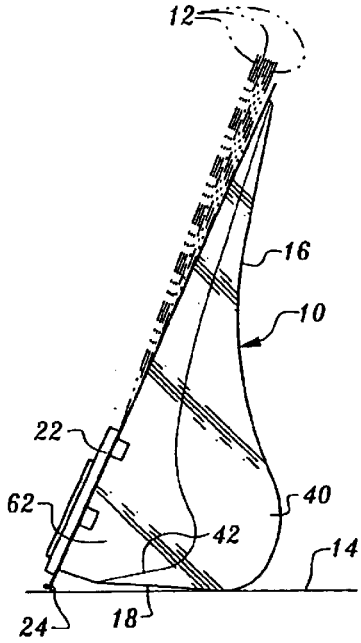
FIG. 3 is a side, elevational view of the holder illustrating positioning of the printed matter held thereby.

Referring now to the drawings, a holder constructed in accordance with the teachings of the present invention is designated by reference number 10. In FIGS. 1 and 3, the holder is shown as supporting a plurality of flat articles in the form of printed paper sheets 12. In FIG. 3, the sheets are illustrated in phantom lines.

The illustrated holder is integrally formed of molded plastic material such as clear polyethylene or polyvinyl chloride. The holder is suitably vacuum thermoformed from a single plastic material sheet.

The holder is of free standing character. FIG. 3 illustrates the holder positioned on and supported by a horizontal support surface 14 such as the top of a counter. The holder holds the printed sheets or other flat articles held thereby to maintain them on edge in a generally vertical orientation for manual access and removal by individuals.

The holder includes a holder back 16 and a holder bottom 18 integral with and projecting forwardly from the holder back.

The holder also includes a holder front spaced from the holder back. The holder front includes a rectangular-shaped stiffener projection 20 and a front panel 22 integrally connected to the bottom of stiffener projection 20 by a molded live hinge 24. The holder back 16, the holder bottom 18 and the holder front define a holder interior 30 for accommodating flat articles 12. The continuous stiffener projection 20 radiates outwardly from the periphery of the rest or remainder of the holder and surrounds the holder interior 30.

Figure 2:
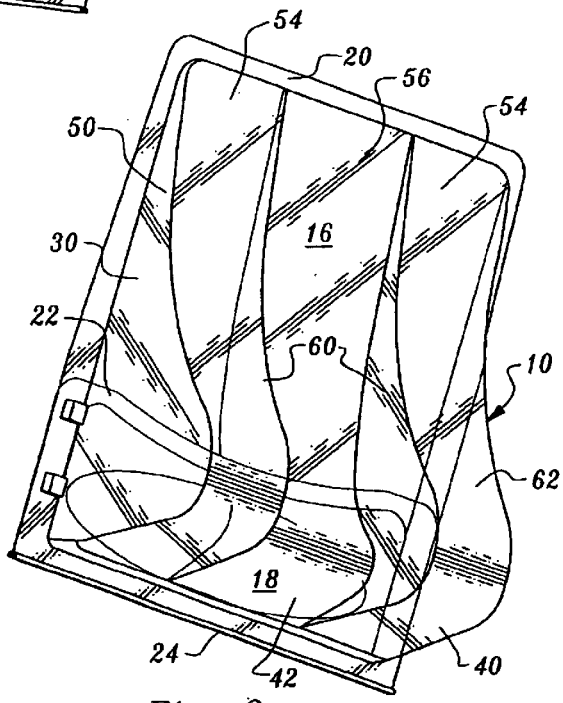
FIG. 2 is a perspective view of the holder with the interior thereof empty.
Figure 4:
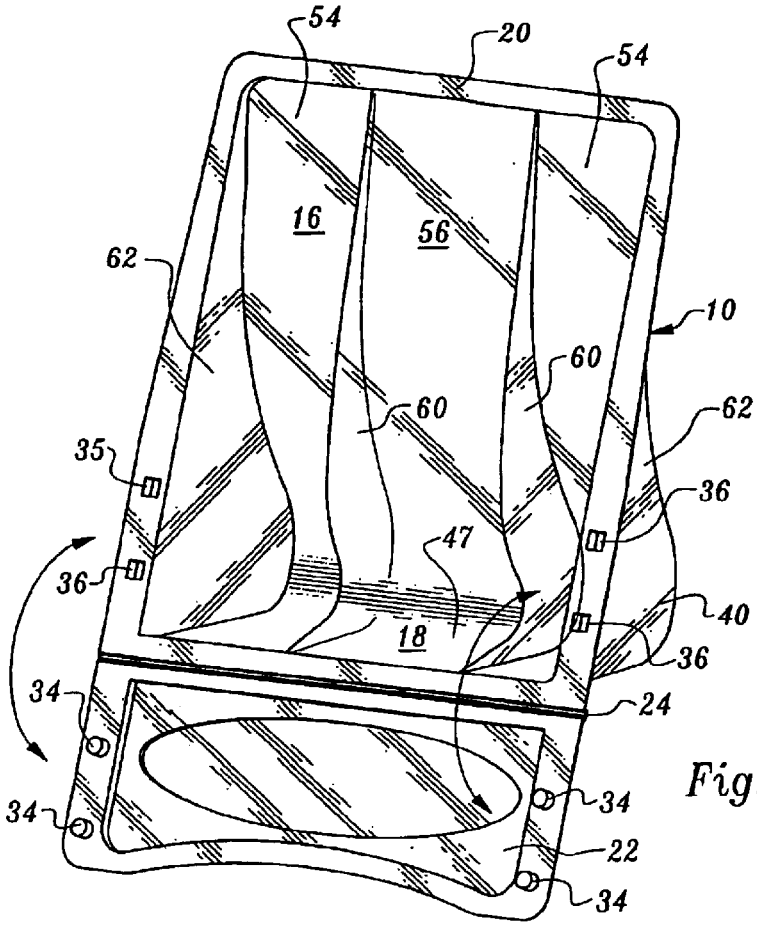
FIG. 4 is a perspective view illustrating a front panel of the holder in open position and not covering the holder back, double-headed arrows illustrating the path of pivotal movement of the front panel between opened and closed positions.
Figure 5:
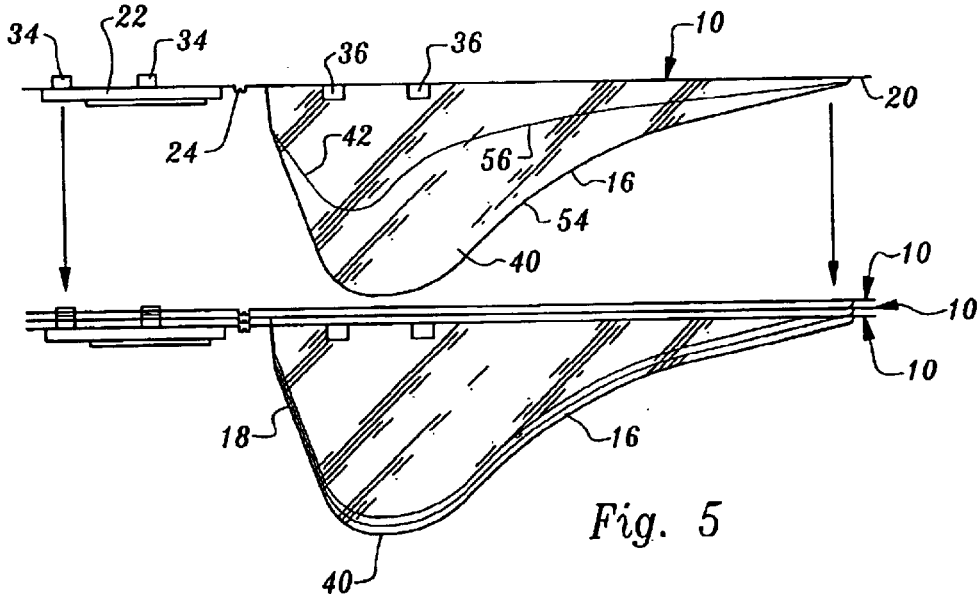
FIG. 5 is a side, elevational view illustrating three of the holders stacked in nesting relationship with a fourth holder just prior to movement into nesting condition with the holders in the stack.

The front panel 22 is selectively movable between a position shown in FIGS. 1, 2 and 3 wherein the front panel partially covers the holder back and a second position, shown in FIGS. 4 and 5, wherein the front panel does not cover the holder back. Locking detents 34 are molded at the ends of the front panel 22 and locking indents 36 are molded into stiffener projection 20 to receive the locking detents when the front panel is in closed position, as shown in FIGS. 1–3. The locking indents and the locking detents are sized so that the detents are frictionally locked in position but can be removed from the indents to open the front panel when a sufficient pulling force is exerted on the front panel by an individual. When closed, flat ends of the front panel are in face-to-face, abutting engagement with flat stiffener projection 20 to contribute to stability of the holder.

The holder back 16 and the holder bottom 18 form two rearwardly projecting support legs 40 for engagement with a horizontal support surface to support the holder. The holder bottom 18 includes a flat article engagement surface 42 inclined downwardly in the direction of the holder front for promoting movement of the flat articles in the holder interior toward the holder front. The front panel is engageable by the flat articles to limit forward movement thereof. The holder defines an access opening 50 adjoining the front panel 22 and communicating with the holder interior to facilitate manual access to and removal of the flat articles disposed on edge on the engagement surface 42.

Each of the support legs 40 is smoothly curved at the juncture of the holder back and the holder bottom. Each support leg includes a support leg central panel 54 projecting rearwardly of a back central panel 56 located between the support legs. Each support leg also includes a pair of spaced support leg side panels 60, 62. Each of the support leg side panels 60 extends between and interconnects its respective associated support leg central panel 54 and the back central panel 56. Each of the support leg side panels 62 extends between and interconnects its associated support leg central panel 54 with the holder front.

The back central panel 56, the support leg side panels 60, 62 and the support leg central panels 54 define three generally vertically oriented channels having generally U-shaped cross-sectional configurations and which are disposed side-by-side. This arrangement in conjunction with the interconnected stiffener projection 20 and connected front panel 22 forms a strong, rigid construction. The support legs 40 and the hinge 24 located at the bottom of stiffener projection 20 provide a stable three point support for the holder and flat articles held thereby, the bottom of the hinge acting as an elongated support engagement surface.

The invention claimed is:

1. A free standing holder of unitary molded plastic construction for positioning on a horizontal support surface and for holding flat articles to maintain the flat articles on edge in a generally vertical orientation for manual access and removal by individuals while the flat articles are maintained on edge in a generally vertical orientation, said holder comprising, in combination:

a holder back;

a holder bottom integral with and projecting forwardly from said holder back; and a holder front spaced from said holder back, said holder back, said holder bottom and said holder front defining a holder interior for accommodating said flat articles, said holder back and said holder bottom forming at least one rearwardly projecting support leg for engagement with a horizontal support surface to support said holder and said holder bottom including a flat article engagement surface inclined downwardly in the direction of said holder front for promoting movement of the flat articles in said holder interior toward said holder front, said holder front including a front panel and an outwardly radiating stiffener projection at least partially surrounding said holder interior, said front panel connected by a hinge to said stiffener projection and selectively movable between a first position wherein said front panel partially covers said holder back and limits forward movement of said flat articles while the flat articles are maintained on edge and a second position wherein said front panel does not limit forward movement of the flat articles, said holder defining an access opening adjoining said front panel communicating with said holder interior and allowing manual access to said flat articles when the flat articles are disposed on edge in a generally vertical orientation and said front panel is in said first position, said holder back and said holder bottom forming at least two spaced, rearwardly protecting support legs for engagement with a horizontal support surface to support said holder.

2. The holder according to claim 1 wherein said holder includes a support engagement surface spaced from said support legs for positioning on and engagement with the horizontal support surface to support the holder.

3. The holder according to claim 1 additionally comprising locking detents and locking indents cooperable to selectively releasably lock said front panel in said first position.

4. The holder according to claim 1 wherein said support legs are smoothly curved at the juncture of said holder back and said holder bottom.

5. The holder according to claim 1 wherein said front panel has flat ends for abutting face-to-face engagement with said stiffener projection.

6. A free standing holder of unitary molded plastic construction for positioning on a horizontal support surface and for holding flat articles to maintain the flat articles on edge in a generally vertical orientation for manual access and removal by individuals, said holder comprising, in combination:

a holder back;

a holder bottom integral with and projecting forwardly from said holder back; and a holder front spaced from said holder back, said holder back, said holder bottom and said holder front defining a holder interior for accommodating said flat articles, said holder back and said holder bottom forming at least one rearwardly projecting support leg for engagement with a horizontal support surface to support said holder and said holder bottom including a flat article engagement surface inclined downwardly in the direction of said holder front for promoting movement of the flat articles in said holder interior toward said holder front, said holder back and said holder bottom forming at least two spaced, rearwardly projecting support legs in engagement with a horizontal support surface to support said holder, said holder back including a back central panel located between said support legs, each of said support legs including a support leg central panel projecting rearwardly of said back central panel and a pair of spaced support leg side panels, one of said support leg side panels of each pair of support leg side panels extending between and interconnecting said support leg central panel and said back central panel and the other support leg side panel of each pair of support leg side panels extending between and interconnecting its associated support leg central panel with said holder front.

7. The holder according to claim 6 wherein said back central panel, said support leg side panels and said support leg central panels define three generally vertically oriented channels having generally U-shaped cross-sectional configurations and disposed side-by-side.

* * * * *